US006659811B2

(12) United States Patent
Okamoto et al.

(10) Patent No.: US 6,659,811 B2
(45) Date of Patent: Dec. 9, 2003

(54) CONNECTOR

(75) Inventors: Michiaki Okamoto, Yokkaichi (JP); Toshifumi Ichio, Yokkaichi (JP); Keigo Atsumi, Yokkaichi (JP); Masanori Wakui, Aichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/114,554

(22) Filed: Apr. 1, 2002

(65) Prior Publication Data

US 2003/0087562 A1 May 8, 2003

(30) Foreign Application Priority Data

Apr. 11, 2001 (JP) ..... 2001-112969

(51) Int. Cl.[7] ..... H01K 13/436
(52) U.S. Cl. ..... 439/752; 439/488
(58) Field of Search ..... 439/752, 595, 439/271, 488

(56) References Cited

U.S. PATENT DOCUMENTS

| | | | | |
|---|---|---|---|---|
| 5,203,722 A | * | 4/1993 | Kinoshita | 439/595 |
| 5,906,499 A | * | 5/1999 | Sikora et al. | 439/271 |
| 6,183,314 B1 | * | 2/2001 | Wada et al. | 439/752 |
| 6,193,551 B1 | | 2/2001 | Yamamoto et al. | |

* cited by examiner

*Primary Examiner*—Gary Paumen
(74) *Attorney, Agent, or Firm*—Gerald E. Hespos; Anthony J. Casella

(57) ABSTRACT

A connector has a housing main body (10) with a terminal accommodating portion (11) for accommodating terminal fittings (13). A holder (50) for supporting front ends of the terminal fittings (13) is assembled to the terminal accommodating portion (11), and a retainer (40) for locking the terminal fittings (13) is mounted laterally into the terminal accommodating portion (11). A detecting portion (45) is retracted from an opening (62) formed in the holder (50) when the retainer (40) is at a partial locking position, but is visible at the opening (62) when the retainer (40) reaches a full locking position.

13 Claims, 15 Drawing Sheets

CONNECTOR

BACKGROUND OF THE INVENTION

1. Field of the Invention

The invention relates to a connector with a retainer.

2. Description of the Related Art

A side retainer type of connector is disclosed in U.S. Pat. No. 5,203,722. This known connector has a housing with opposite front and rear ends and cavities that extend between the ends for receiving terminal fittings. A retainer is inserted into one side of the housing and initially is held at a partial locking position where the retainer is retracted from the cavities. Hence the terminal fittings can be inserted into the cavities. The retainer then can be pushed to a full locking position where the retainer enters the cavities and locks the terminal fittings in the cavities.

The retainer has a rear end that projects from the side surface of the housing when the retainer is at the partial locking position. However, the rear end of the retainer is flush with the side surface of the housing when the retainer reaches the full locking position. Thus, an operator can detect the position of the retainer merely by touching the housing.

The side retainer type of connector may be a female watertight connector that has a terminal accommodating portion surrounded by a receptacle. The retainer of such a connector typically is mounted on the terminal accommodating portion and is retracted inwardly from the receptacle. Thus, the position of the retainer must be detected visually to determine whether the rear end of the retainer is flush with a side surface of the terminal accommodating portion. However, the positional relationship of the retainer relative to the terminal accommodating portion cannot be confirmed precisely if the angle of viewing is inclined, even slightly, from a proper specified angle. Thus, it has been difficult to detect the position of the retainer.

The present invention was developed in view of the above problem, and an object thereof is to provide a connector that enables a precise position detection of a retainer.

SUMMARY OF THE INVENTION

The invention is directed to a connector that has a housing into which at least one terminal fitting is insertable. A retainer is insertable into the housing at angle to an inserting direction of the terminal fitting and is engageable with the terminal fitting to lock the terminal fitting when the retainer reaches a proper lock position. The housing has an opening, and the retainer has a detecting portion that faces the opening so that the detecting portion can be seen from outside only when the retainer reaches the proper lock position.

The position of the retainer can be detected precisely based on whether the detecting portion can be seen from the outside through the opening. Accordingly, either a visual or an automatic inspection may be performed.

The housing preferably comprises a terminal accommodating portion that accommodates the terminal fitting and into which the retainer is mountable. A receptacle may substantially surround the terminal accommodating portion. A rear end of the retainer with respect to its inserting direction projects out from the terminal accommodating portion before the retainer reaches the proper position with respect to the terminal accommodating portion. However, the rear end of the retainer is in the terminal accommodating portion and the detecting portion faces the opening when the retainer reaches the proper position.

The position of the retainer can be detected based on whether the rear end of the retainer is in the terminal accommodating portion or whether the detecting portion faces the opening. The position of the retainer can be detected more precisely by looking at both the detecting portion and the rear end of the retainer.

The detecting portion preferably is colored differently from an edge of the opening in the housing. Thus, the position of the retainer can be detected more precisely because the detecting portion can be seen more easily. Also an automatic detection may be possible, such as by a color detection system.

The retainer preferably comprises first and second holding means that cooperate with mating holding means on the housing for holding the retainer alternately in a preliminary or non-lock position and in a proper or lock position. The retainer in the preliminary position does not lock the terminal fitting and allows insertion of the terminal fitting into the housing. However, the retainer in the proper position locks the terminal fitting.

The retainer may have at least one locking projection for engaging the terminal fitting and locking the terminal fitting in the housing.

The housing preferably comprises a housing main body and a holder that is mountable on the housing main body. The holder preferably has a stop wall for supporting the terminal fitting that has been inserted into the housing main body. The opening preferably is provided in the holder.

A sealing ring preferably is provided on the connector housing for providing a sealing or waterproofing function when the connector is mated with a mating connector. The holder may be provided with a sealing ring holder for locking the sealing ring by engaging the sealing ring from the front.

These and other objects, features and advantages of the present invention will become more apparent upon reading of the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

Figure 2:
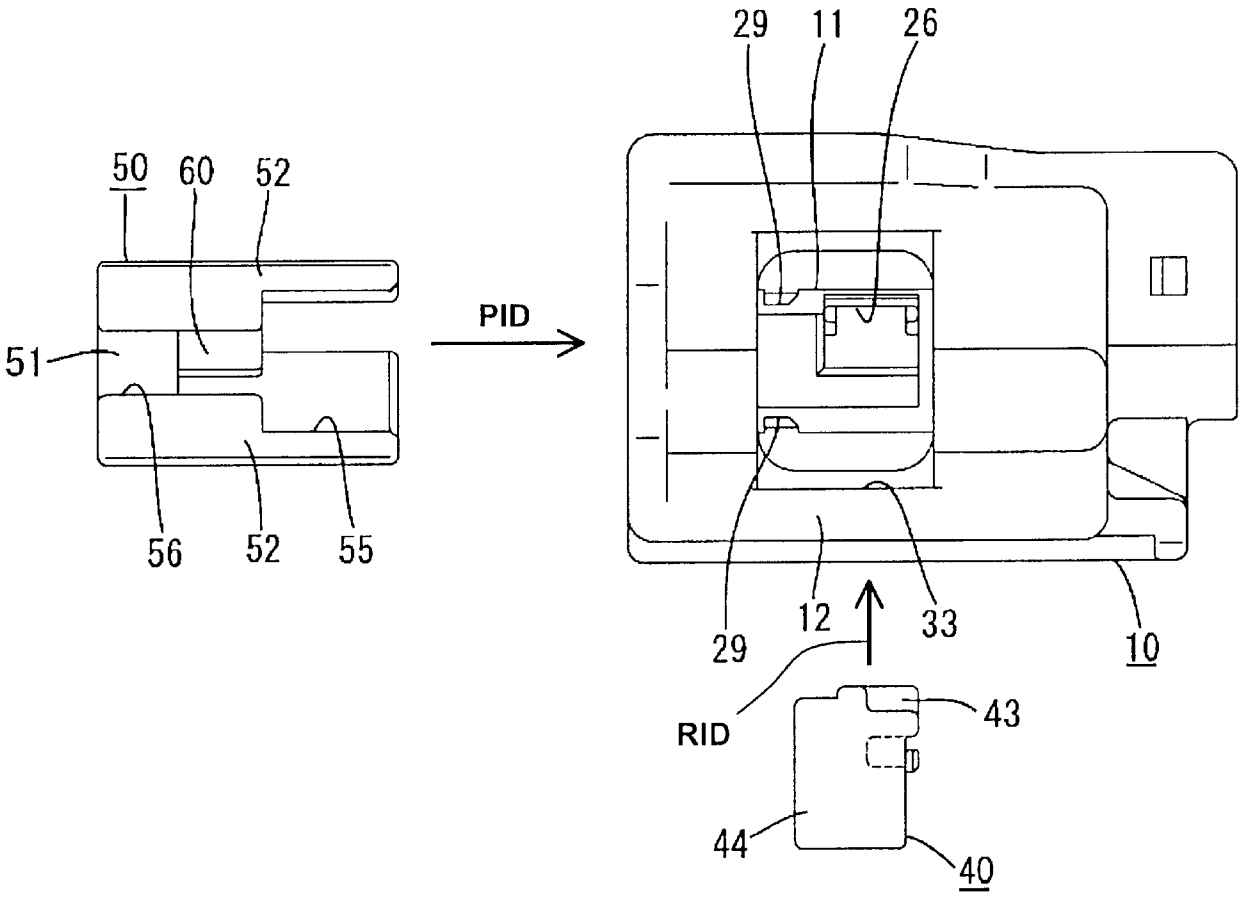
FIG. 2 is a side view of the housing main body, the holding member and the retainer.
Figure 3:
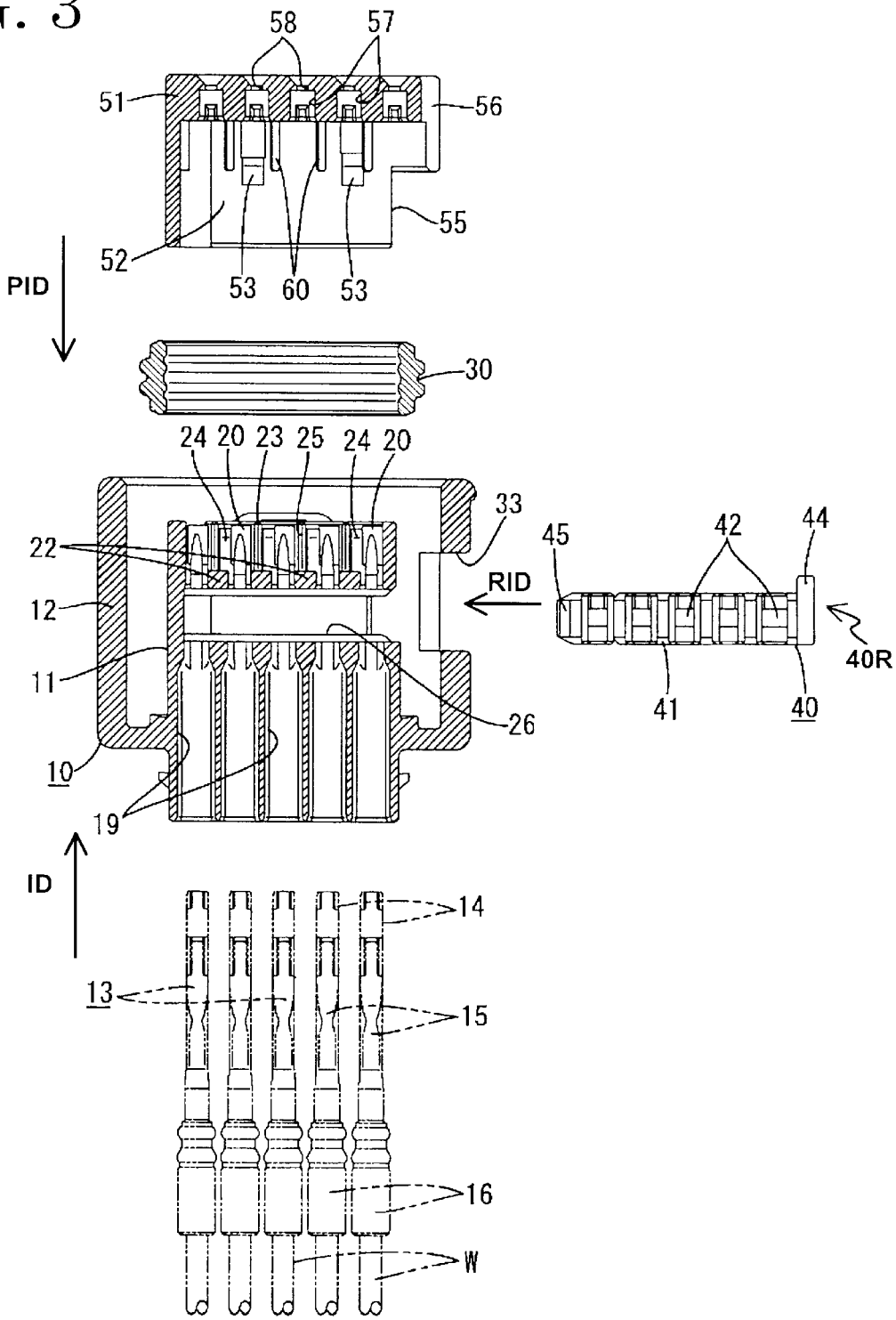
FIG. 3 is a section along 3—3 of FIG. 1 showing an exploded state of a female connector.
Figure 4:
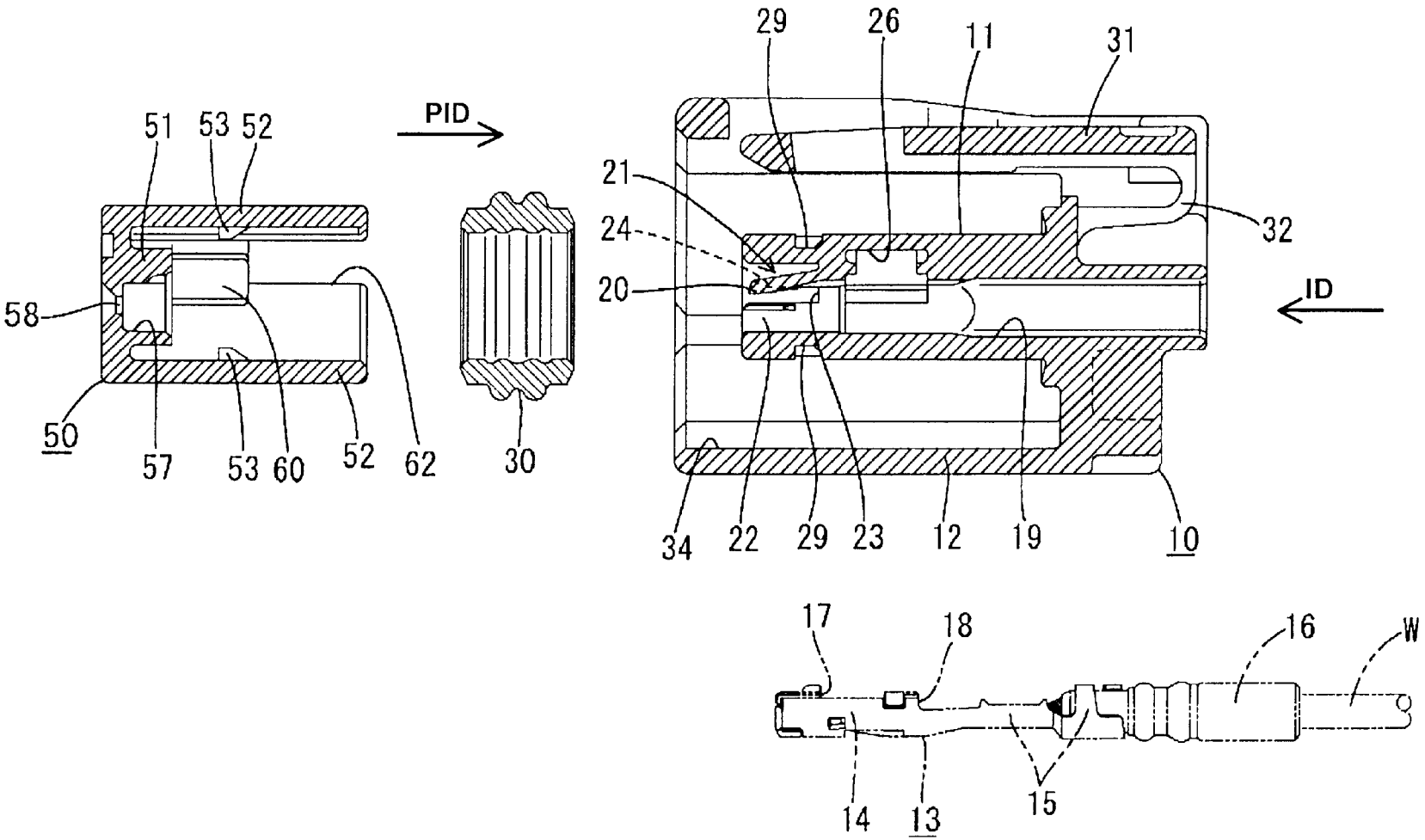
FIG. 4 is a section along 4—4 of FIG. 1 showing the exploded state of the female connector.

A female connector according to the invention is illustrated in FIGS. 1 to 16 and includes a housing main body 10 that is made of a synthetic resin. The housing main body 10 has a terminal accommodating portion 11 and a receptacle 12 that substantially surrounds the terminal accommodating portion 11, as shown in FIGS. 3 and 4.

The connector further includes terminal fittings 13, each of which has opposite front and rear ends. A substantially box-shaped connecting portion 14 is formed at the front end of each terminal fitting 13 and a barrel 15 is formed at the rear end. The barrel 15 is configured for crimped connection with an end of a wire W. A rubber plug 16 is mounted at the end of the insulation coating of the wire W and is fixed by crimping the barrel 15. An engaging portion 17 projects from an upper surface of the connecting portion 14, and jaws 18 are formed at the rear end of the connecting portion 14.

The terminal accommodating portion 11 of the housing main body 10 is formed with a side-by-side array of cavities 19. The front half of each cavity 19 has a substantially rectangular cross section that conforms to the connecting portion 14 of the terminal fitting 13. The rear half of each cavity 19 has a round cross section that conforms to the rubber plug 16. Thus, the terminal fittings 13 can be inserted into the respective cavities from the rear along an insertion direction ID so that the rubber plugs 16 can be held in close contact with the inner surface of the respective cavity 19 to protect the inside of the cavity 19 from water.

Figure 9:
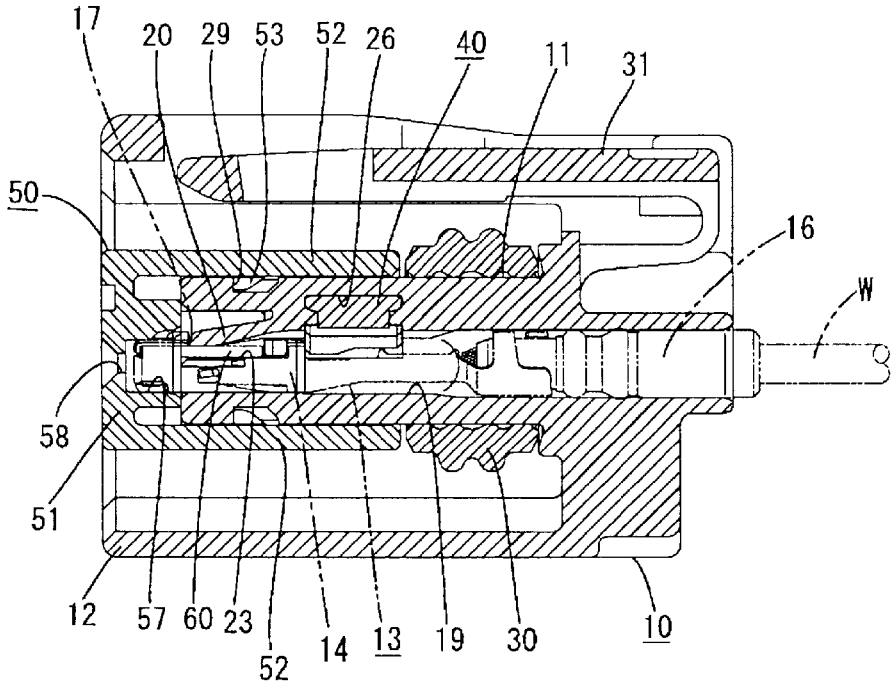
FIG. 9 is a section along 9—9 of FIG. 7.

A lock 20 is cantilevered from the upper front of each cavity 19 and intersects the inserting direction ID of the terminal fitting 13. The lock 20 is resiliently deformable in response to forces generated during insertion of the terminal fitting 13 into the cavity 19 so that the deformed lock 20 projects into a deformation permitting space 21 above the terminal fitting 13. The lock 20 then is restored resiliently to engage the engaging portion 17 when the terminal fitting 13 reaches its proper position in the cavity 19. At this time, the front end of the terminal fitting 13 projects forward from the terminal accommodating portion 11, as shown in FIG. 9.

Partition walls 22 partition the front halves of adjacent cavities 19 and are slightly narrower than the front halves of the cavities 19. Each partition wall 22 has a notch 23 that opens forward from a location aligned with the base end of the respective lock 20. Each notch 23 extends slightly over the half the height of the partition wall 22 from the upper end of the partition wall 22 to a position below the bottom end of the lock 20. Substantially V-shaped positioning grooves 25 are formed in the upper and lower surfaces of the notches 23. An unlocking piece 24 extends forwardly along the left side of the corresponding lock 20 in FIG. 1 from a location aligned with the back end of the notch 23. The locking pieces 24 preferably are about half as wide as the notches 23. The lock 20 is deformed resiliently by pressing the unlocking piece 24 with a jig to disengage the lock 20 from the terminal fitting 13.

Figure 5:
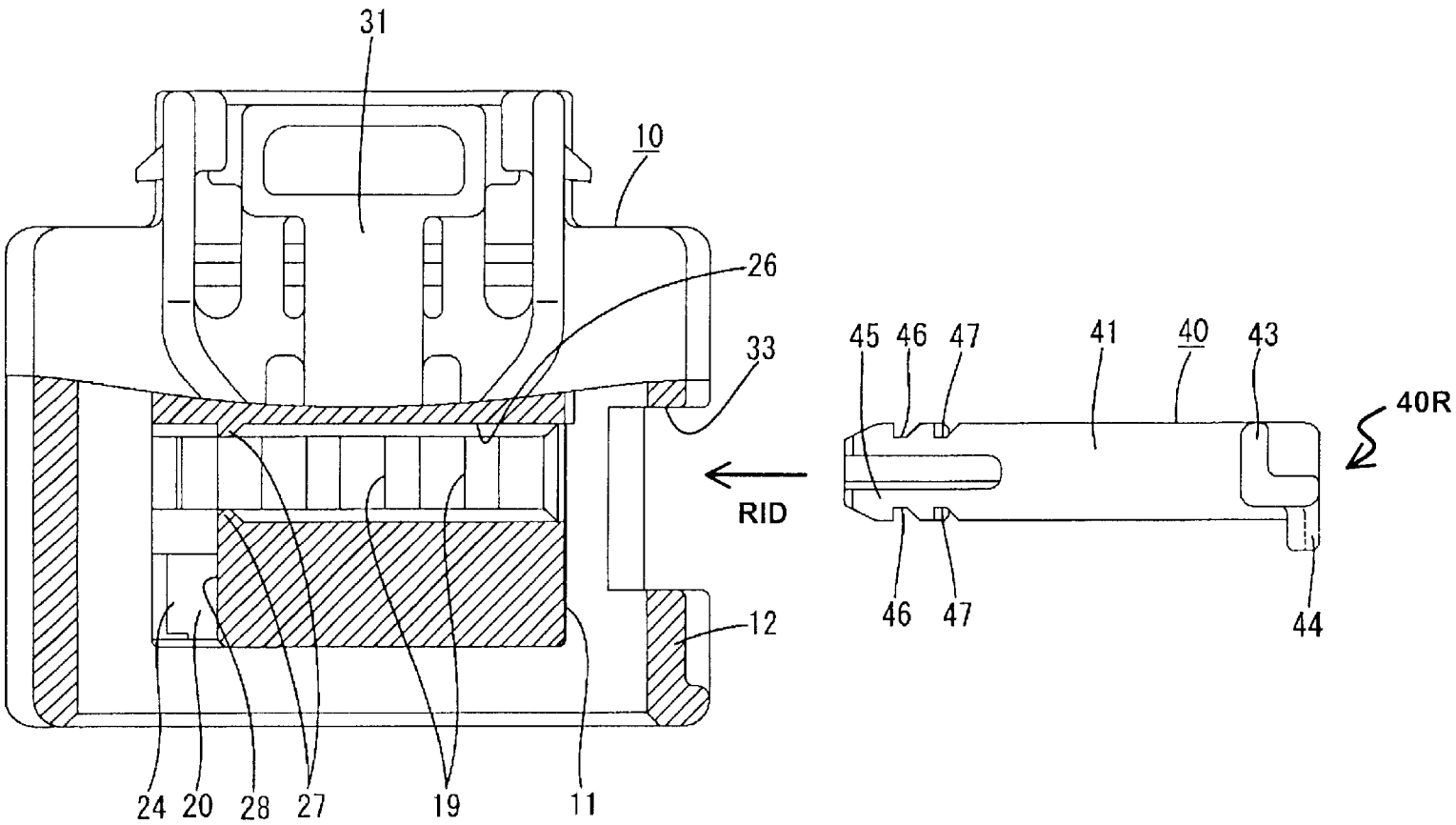
FIG. 5 is a section along 5—5 of FIG. 1 showing the housing main body and the retainer.

A retainer mount hole 26 penetrates the terminal accommodating portion 11 slightly behind the locks 20 and communicates with the respective cavities 19, as shown in FIGS. 3 and 4. Two holding projections 27 are provided at the back side of edges of the retainer mount hole 26, as shown in FIG. 5, and a mold-removal hole 28 opens forwardly on the terminal accommodating portion 11 for forming the back end surface of the holding projections 27. Transversely extending holding grooves 29 are formed on the upper and lower surfaces of the terminal accommodating portion 11, as shown in FIG. 4. Slanted surfaces are formed on each of the upper and lower sides of the front end surface of the terminal accommodating portion 11.

The receptacle 12 is a forwardly open rectangular tube that is coupled to the terminal accommodating portion 11 by a coupling portion that bulges out from the rear end of the terminal accommodating portion 11. A mating male connector (not shown) can be fit into the space between the receptacle 12 and the terminal accommodating portion 11 from the front. A rubber ring 30 is mounted on the outer surface of the terminal accommodating portion 11 and is squeezed between the terminal accommodating portion 11 and the mating male connector to provide a watertight fit between the connectors.

A lock arm 31 is provided in a transverse center of the top of the receptacle 12 for holding the male connector in a connected state. The lock arm 31 has a rear end coupled to the terminal accommodating portion 11 by support arms 32 and has opposite side edges partly coupled to the receptacle 12, as shown in FIG. 5. Thus, the lock arm 12 is resiliently deformable up and down or toward and away from the terminal accommodating portion 11.

A retainer insertion hole 33 is formed in the right wall of the receptacle 12 in FIG. 5. As shown in FIG. 2, the retainer mount hole 26 and the holding grooves 29 are exposed sideways to outside by the retainer insertion hole 33, and the retainer insertion hole 33, the retainer mount hole 26 and the holding grooves 29 are formed by the same mold during the molding of the housing main body 10.

Figure 1:
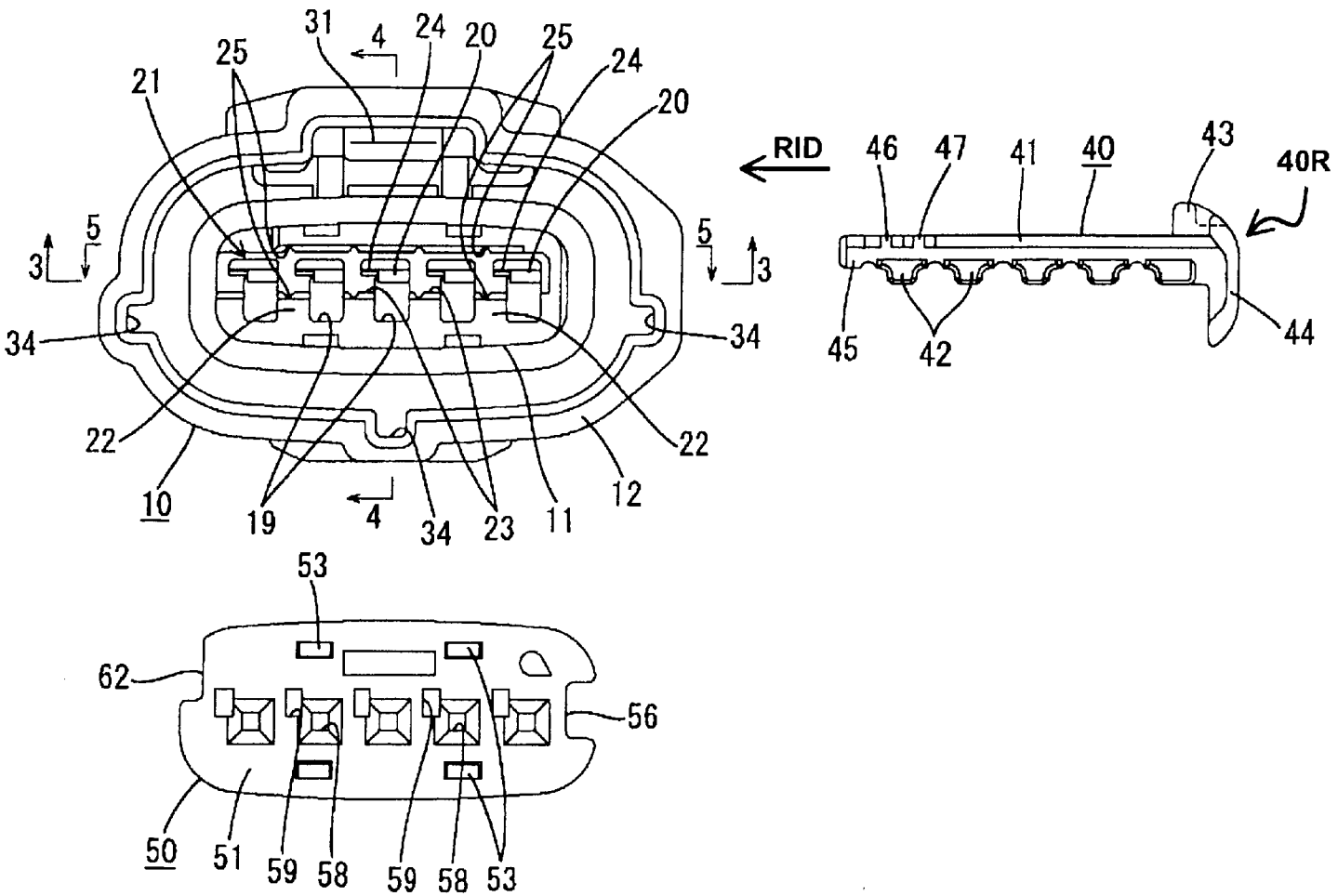
FIG. 1 is a front view of a housing main body, a holding member and a retainer according to one embodiment of the invention.

Opposite sides and the bottom of the receptacle 12 bulge out as shown in FIG. 1 to form three guiding grooves 34 for guiding the connection of the male connector.

The connector further includes a retainer 40 made e.g. of a synthetic resin and preferably colored differently from both the rubber ring 30 and the connector main housing 10. The retainer 40 has a narrow plate-shaped base 41 that can be inserted into the retainer mount hole 26. Locking projections 42 are formed on the lower surface of the base 41 and correspond in number to the number of cavities 19. The locking projections 42 are arrayed at intervals that conform with the intervals of the cavities 19. Thus, the locking projections 42 can project into the respective cavities 19 for engaging the terminal fittings 13. A mount-maneuvering projection 43 is provided on the upper surface of the rear end of the base 41 with respect to an inserting direction RID of the retainer 40 into the terminal accommodating portion 11 and can be pushed from the side by a jig when the retainer 40 is to be mounted. A thin detach-maneuvering piece 44 is provided on the rear surface of the base 41 with respect to the inserting direction RID and can be pushed by a jig in a direction opposite to the insertion direction RID of the retainer 40 when the retainer 40 is to be detached. A detecting portion 45 is provided at the front end of the base 41 and is thicker than the base 41. Further, the side surface at the rear end of the retainer 40 is moderately arcuate.

Two first holding recesses 46 and two second holding recesses 47 are formed in the lateral surfaces near the front of the base 41, as shown in FIG. 5. The retainer 40 can be held in a partial locking position in the terminal accommodating portion 11 by engaging the first holding recesses 46 with the holding projections 27 in the retainer mount hole 26. The retainer also can be held in a full locking or proper position by engaging the second holding recesses 47 with the holding projections 27 in the retainer mount hole 26.

Figure 8:
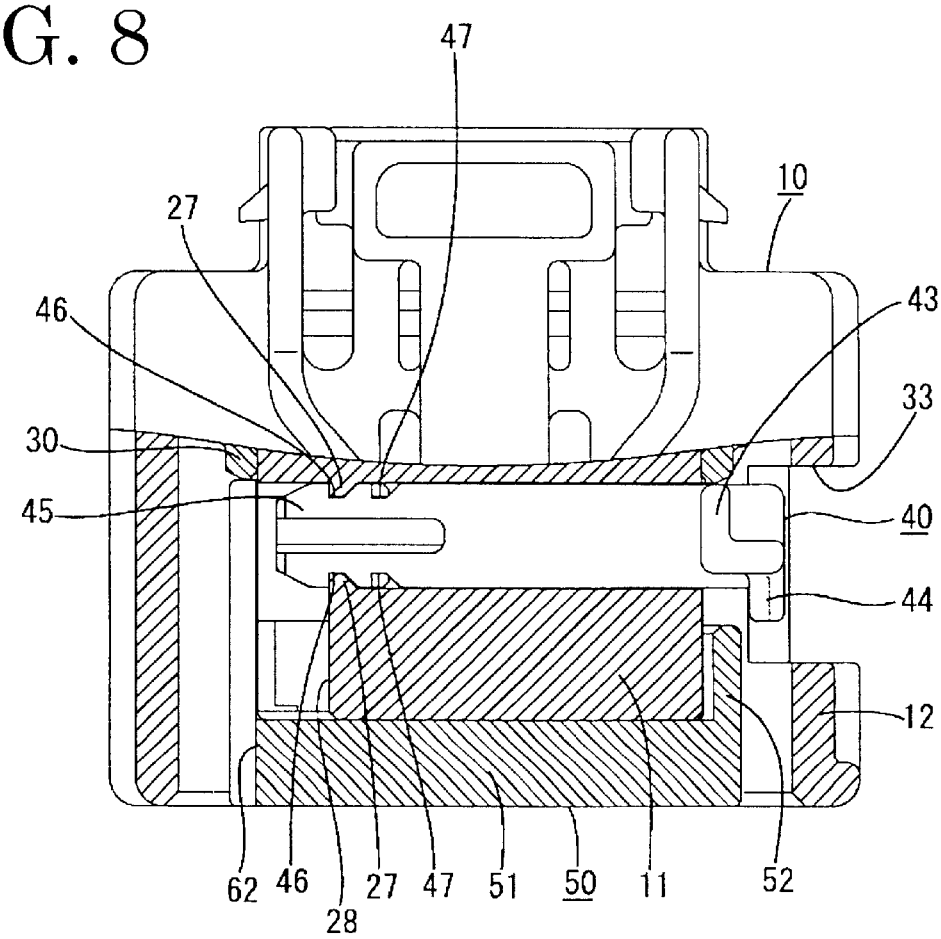
FIG. 8 is a section along 8—8 of FIG. 7.
Figure 10:
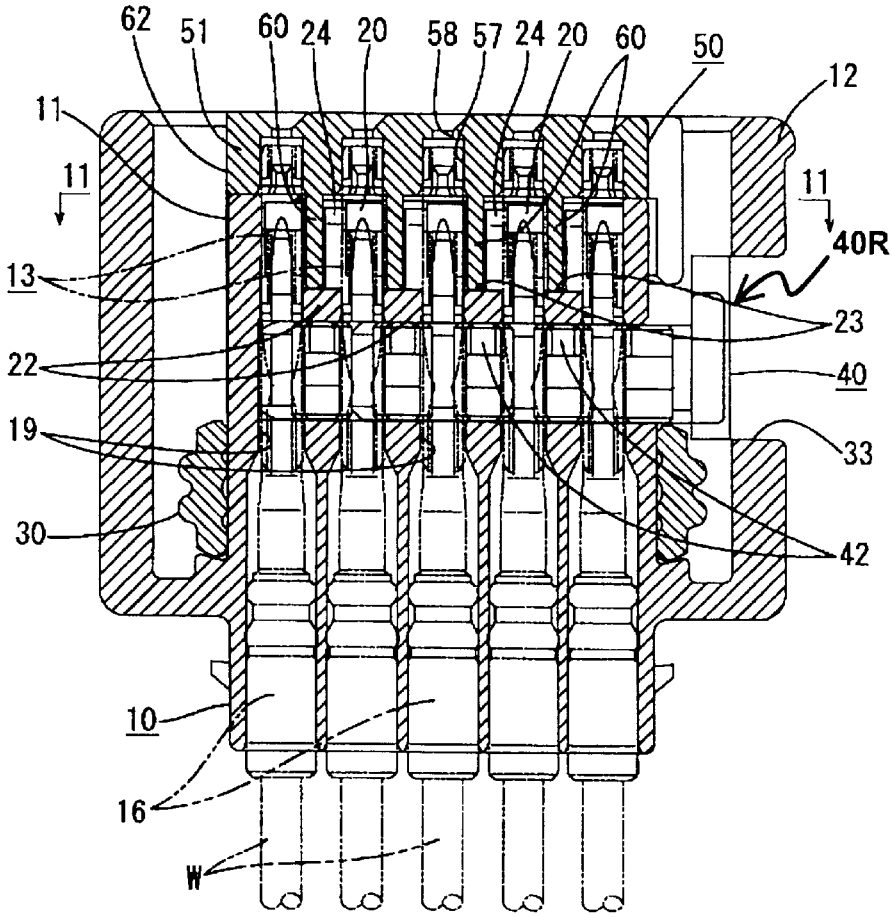
FIG. 10 is a section along 10—10 of FIG. 7.
Figure 11:
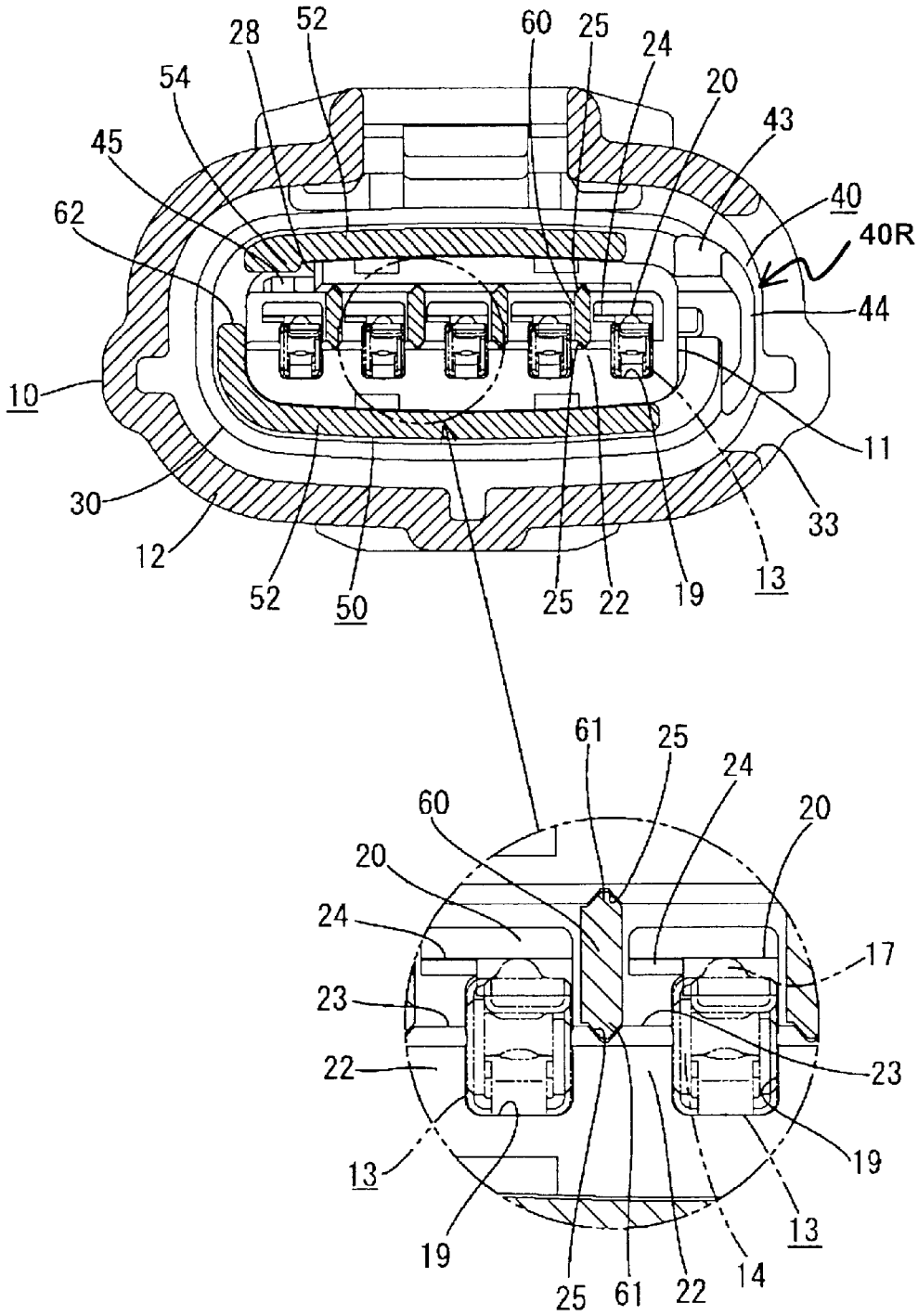
FIG. 11 is a section along 11—11 of FIG. 10.

The retainer 40 is held at the partial locking position when the first holding recesses 46 engage the holding projections 27, as shown in FIG. 8. In this state, the respective locking projections 42 are retracted from the cavities 19 and located substantially at the same positions as the partition walls 22, as shown in FIG. 10. Thus, insertion and withdrawal of the terminal fittings 13 into and from the cavities 19 is permitted. Additionally, the rear end of the retainer 40 projects rightward from the side surface of the terminal accommodating portion 11 and the detecting portion 45 stays in the terminal accommodating portion 11, as shown in FIG. 11.

Figure 13:
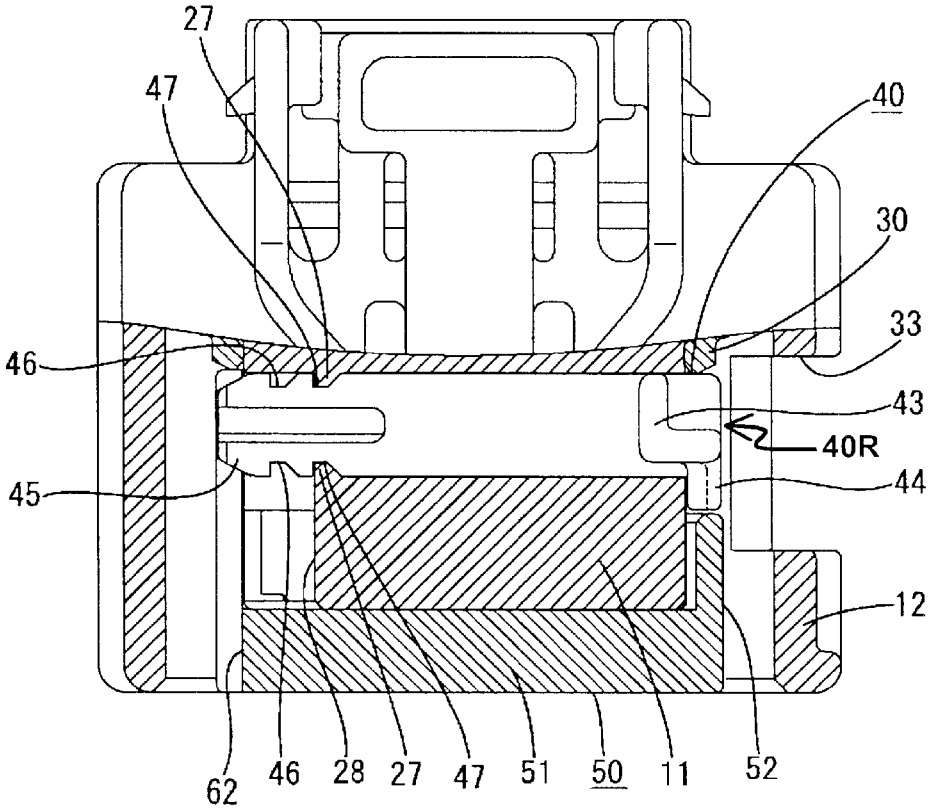
FIG. 13 is a section along 13—13 of FIG. 12.
Figure 14:
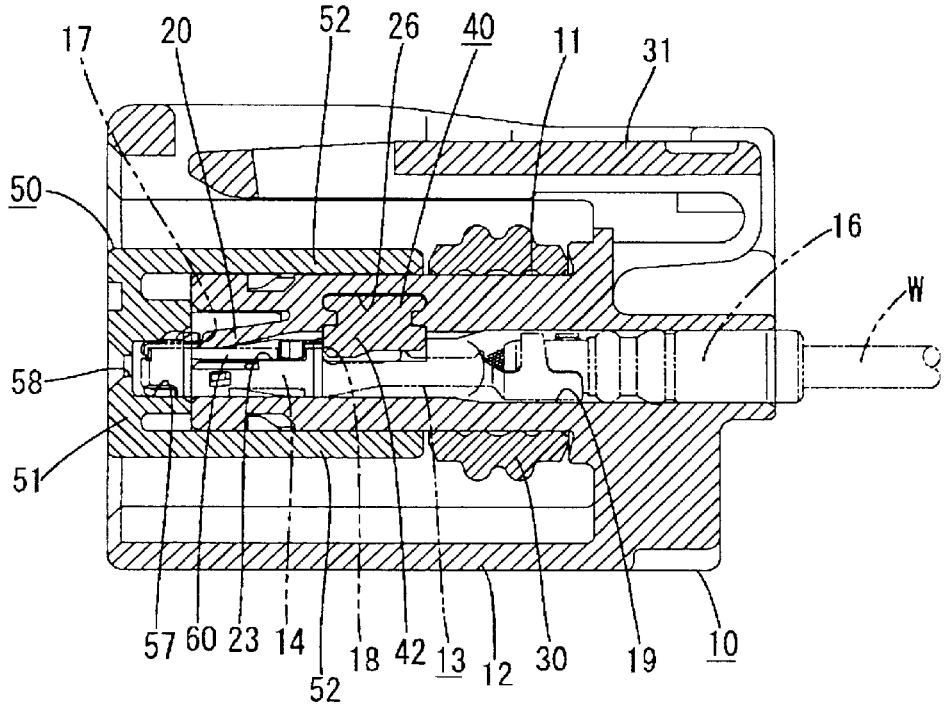
FIG. 14 is a section along 14—14 of FIG. 12.

The retainer 40 can be moved further to engage the second holding recesses 47 with the holding projections 27, as shown in FIG. 13. Thus, the retainer 40 is held at the full locking or proper position. In this state, the respective locking projections 42 enter the cavities 19 to engage jaws 18 at the rear ends of the connecting portions 14 of the terminal fittings 13, as shown in FIG. 14. Additionally, the detecting portion 45 projects left of the terminal accommodating portion 11 in FIG. 16. The locking projections 42 are slightly narrower than the partition walls 22, and thus engage the jaws 18 of the terminal fittings 13 substantially over the entire width.

Figure 6:
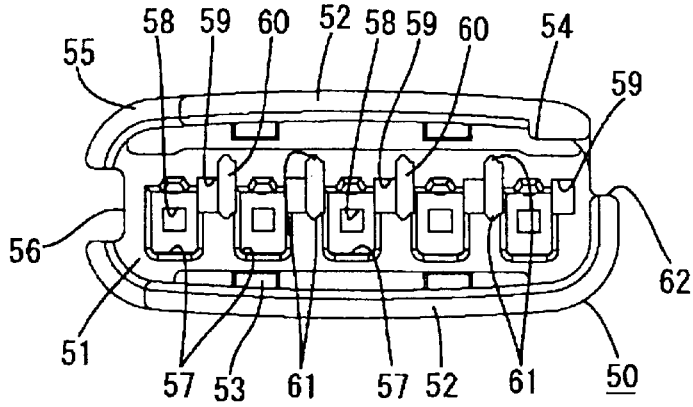
FIG. 6 is a rear view of the holding member.
Figure 12:
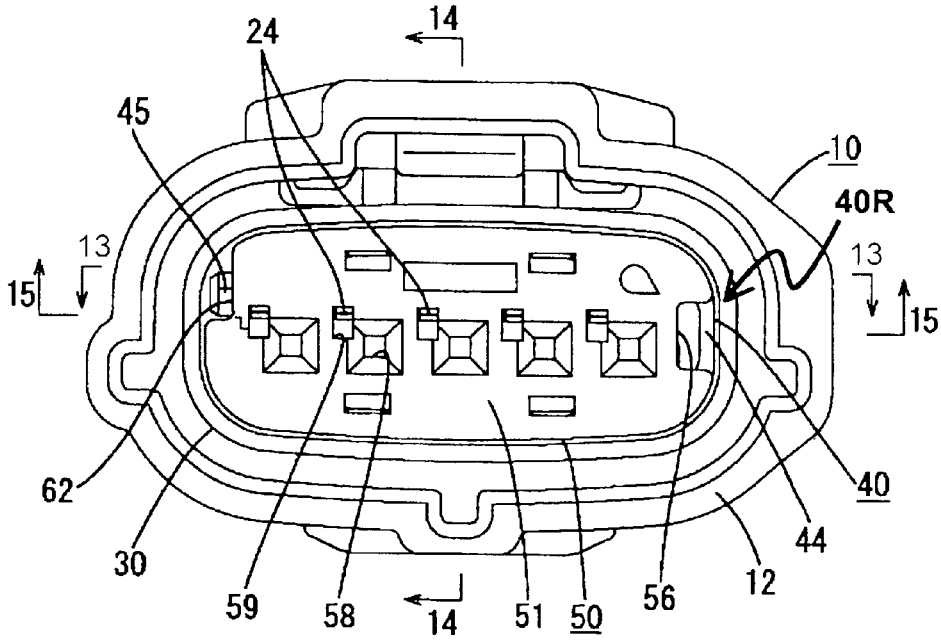
FIG. 12 is a front view showing a state where the retainer is at a full locking position.

The connector further includes a holder 50 made e.g. of a synthetic resin, and preferably colored differently from the retainer 40 and/or the rubber ring 30. The holder 50 has a substantially elliptical front wall 51 and upper and lower holding plates 52 that project back from the front wall 51, as shown in FIG. 6. The upper and lower holding plates 52 can be fit on the outer surface of the terminal accommodating portion 11, as shown in FIG. 4, and holding projections 53 are provided on the inner surface of the upper and lower holding plates 52. The holder 50 is assembled to the terminal accommodating portion 11 by engaging the holding projections 53 with the holding grooves 29 formed in the terminal accommodating portion 11. In this state, the holding plates 52 are engageable with the front end surface of the rubber ring 30 and prevent the rubber ring 30 from coming out (see FIG. 9). A bulge 54 is provided on the lower surface of a right end portion of the upper holding plate 52, as shown in FIG. 6, and can enter the mold-removal hole 28 of the terminal accommodating portion 11 (see FIG. 11). The retainer 40 also has a communicating portion 55 that opens laterally between the left ends of the upper and lower holding plates 52 in FIG. 6 and communicates with the retainer mount hole 26 and the retainer insertion hole 33. A jig insertion recess 56 is formed in the front wall 51 and allows the detach-maneuvering piece 44 of the retainer 40 to be exposed forward to the outside when the retainer 40 is at the full locking position, as shown in FIG. 12. Thus, a jig can be inserted through the jig insertion recess 56 to manipulate the detach-maneuvering piece 44.

Figure 7:
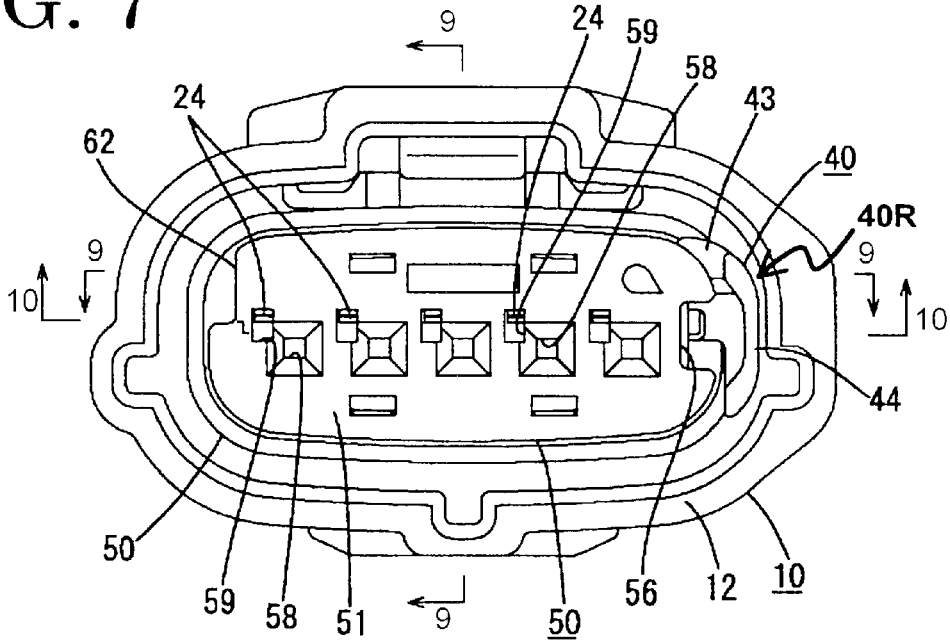
FIG. 7 is a front view showing a state where the retainer is mounted at a partial locking position on the housing main body in which the holding member is mounted.

Fitting recesses 57 are formed substantially side-by-side at positions aligned with the cavities 19, as shown in FIGS. 3 and 4. The front ends of the terminal fittings 13 project beyond the terminal accommodating portion 11 and are supported by the fitting recesses 57 to prevent movement in vertical, lateral and forward directions. Insertion holes 58 are formed in center positions of the respective fitting recesses 57, as shown in FIG. 6 and receive mating male terminal fittings of the mating male connector. Jig insertion holes 59 penetrate the front wall 51 substantially longitudinally along the insertion direction ID for communicating with the upper right portions of the fitting recesses 57 in FIG. 6. The jig insertion holes 59 are formed at positions to expose the unlocking pieces 24 of the locks 20 forward to the outside and to permit insertion of the jig from the front to manipulate the unlocking pieces 24, as shown in FIG. 7. The jig insertion holes 59 are formed at positions obliquely displaced from the insertion holes 58. Thus, the male terminal fittings are unlikely to erroneously enter the jig insertion holes 59 even if the mating male connector is inclined during connection of the two connectors.

Partition walls 60 project back from the rear of the front wall 51 at positions to the right of the jig insertion holes 59 and to the left of the fitting recesses 57, as shown in FIG. 6. The partition walls 60 are insertable in a partition insertion direction PID into the respective notches 23, as shown in FIG. 11, when the holder 50 is mounted on the terminal accommodating portion 11. The partition walls 60 are inserted until the rear ends of the partition walls 60 contact the back ends of the notches 23. Thus, the partition walls 60 completely close the notches 23. The partition walls 60 insulate the terminal fittings 13 inserted into the adjacent cavities 19 from each other, and the side surfaces of the partition walls 60 form parts of the side surfaces of the cavities 19. The width of the partition walls 60 is about half the width of the partition walls 22. Accordingly, minimum clearances are provided between the partition walls 60 and the locks 20 or the unlocking pieces 24 so as not to hinder the resilient deformation of the locks 20. More specifically, the left side surfaces of the partition walls 60 in FIG. 10 are recessed slightly from inner side surfaces of the fitting recesses 57 and the cavities 19.

Substantially triangular positioning projections 61 project up and down at the upper and lower ends of each partition wall 60, as shown in FIG. 11. The positioning projections 61 engage the substantially V-shaped positioning grooves 25 formed in the notches 23 to maintain the partition walls 60 at their proper positions without lateral displacement. More specifically, small horizontal portions continuous with the positioning projections 61 at the right side remain at the left ends of the upper and lower surfaces of the partition walls 60 in FIG. 11, and these horizontal portions are held in contact with the upper and lower surfaces of the notches 23.

As shown in FIGS. 7 and 8, an opening 62 extends longitudinally along the partition insertion direction PID over substantially the entire side of the holder 50 opposite from the communicating portion 55. The opening 62 is formed between the right ends of the upper and lower holding plates 52 of FIG. 6 by cutting away the front wall 51. Additionally, as shown in FIG. 11, the opening 62 is at substantially the same height as the retainer mount hole 26, i.e. the detecting portion 45 of the retainer 40, with the holder 50 mounted on the terminal accommodating portion 11. When the retainer 40 is mounted at the partial locking position, the detecting portion 45 of the retainer 40 is inside the terminal accommodating portion 11 and retracted from the opening 62, as shown in FIGS. 7 and 8. Thus, the detecting portion 45 cannot be seen from the front. On the other hand when the retainer 40 is moved to the full locking position, as shown in FIGS. 12 and 13, the detecting portion 45 projects into the opening 62 so as to be seen from the front. The retainer 40 has a color different from the rubber ring 30 and the holding member 50. Therefore, contrast between the detecting portion 45 and the edge of the opening 62 is clear to facilitate visual confirmation of the detecting portion 45. The connector main housing 10 also may have an opening (not shown) that is substantially opposite to the opening 62 so as to form a hole through the connector main housing 10 and the holder 50. Accordingly, the detection portion 45 may intersect the through hole when the retainer 40 is in the full locking or proper position so that automatic detection of the position of the retainer 40 is possible, e.g. by means of a light source and a light detector (e.g. a diode).

The female connector is assembled by first mounting the rubber ring 30 on the outer surface of the terminal accommodating portion 11 of the housing main body 10 and then mounting the holder 50 on the terminal accommodating portion 11 from the front. Thus, the inner surface of the holding plate 52 is fitted on the outer surface of the terminal accommodating portion 11. Additionally, the holding projections 53 move onto the slanted surfaces and then enter the holding grooves 29 so that the front end surfaces of the holding projections 53 engage the front end surfaces of the holding grooves 29 to secure the holder 50 to the terminal accommodating portion 11, as shown in FIG. 9. At this stage, the rear end surface of the holder 50 engages the front end surface of the rubber ring 30 to hold the rubber ring 30 in position. During this process, the partition walls 60 are inserted into the notches 23, and the upper and lower positioning projections 61 enter the corresponding positioning grooves 25, as shown in FIGS. 10 and 11, to position the partition walls 60 laterally. Thus, the partition walls 60 are inserted smoothly in the partition insertion direction PID into the notches 23 without interfering with the locks 20 and the unlocking pieces 24. The partition walls 60 are inserted until the rear ends of the partition walls 60 contact the backs of the notches 23 and align with the base ends of the locks 20. Thus, the partition walls 60 partition adjacent cavities 19 and the side surfaces of the partition walls 60 form the side surfaces of the cavities 19. In this state, the front end surface of the holder 50 and the front end surface of the housing main body 10 are substantially flush with each other.

The retainer 40 is inserted in the retainer insertion direction RID through the retainer insertion hole 33 of the receptacle 12 and into the retainer mount hole 26 of the terminal accommodating portion 11. The retainer 40 is inserted until the first holding recesses 46 engage the holding projections 27 to hold the retainer at the partial lock position, as shown in FIG. 8. At this stage, the rear end of the retainer 40 with respect to the inserting direction RID is between the holder 50 and the receptacle 12 and can be seen from the front. Further, as shown in FIG. 11, the detecting portion 45 is retracted back from the opening 62 with respect to the inserting direction of the retainer 40. It does not matter which of the holder 50 and the retainer 40 is mounted first.

The terminal fittings 13 are inserted into the cavities 19 so that the connecting portions 14 push the locks 20 at an intermediate stage of insertion. Thus, the locks 20 deform resiliently and project into the deformation permitting spaces 21 above the respective cavities 19. The locks 20 are restored resiliently to engage the engaging portions 17, as shown in FIG. 9, when the terminal fittings 13 reach a proper depth, thereby partly locking the terminal fittings 13. At this time, the front ends of the terminal fittings 13 are into the fitting recesses 57 of the holder 50, as shown in FIGS. 9 and 10. As a result, the terminals 13 are supported and cannot move forward any further. The accommodated terminal fittings 13 are insulated from the terminal fittings 13 in adjacent cavities 19 because the partition walls 60 close the notches 23.

Figure 15:
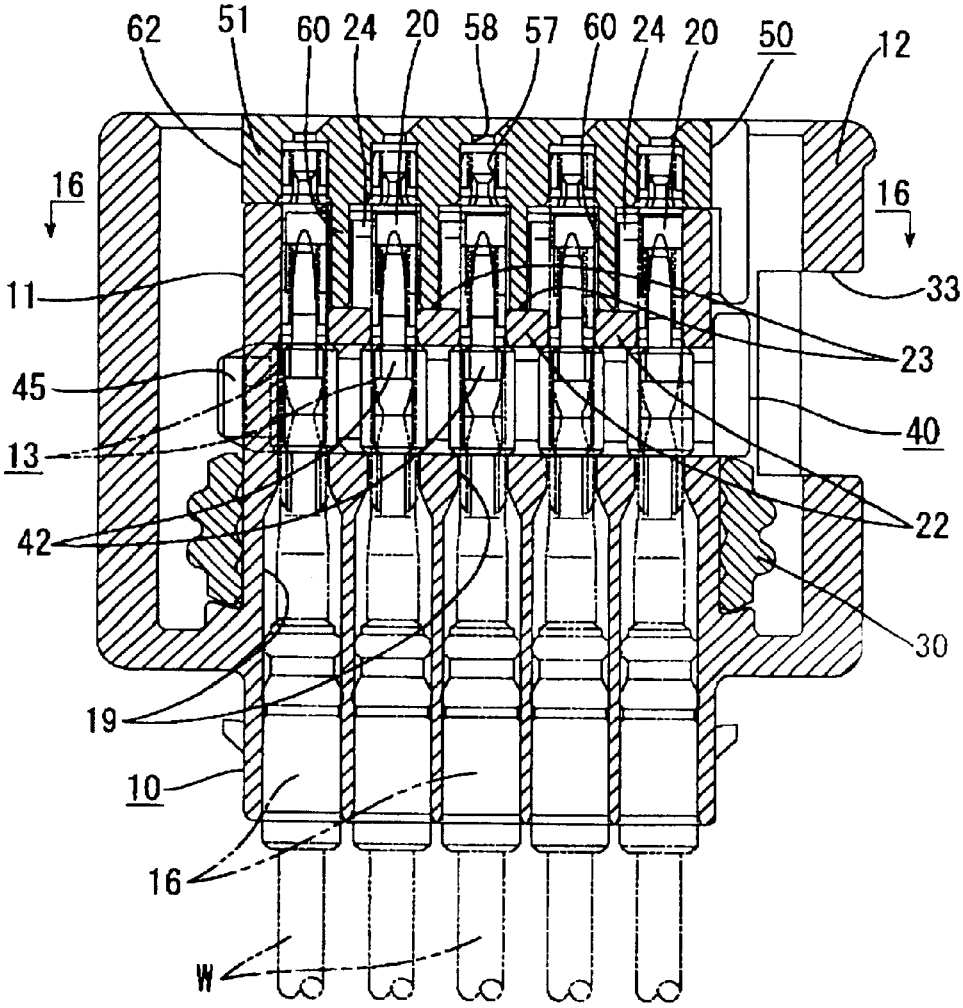
FIG. 15 is a section along 15—15 of FIG. 12.
Figure 16:
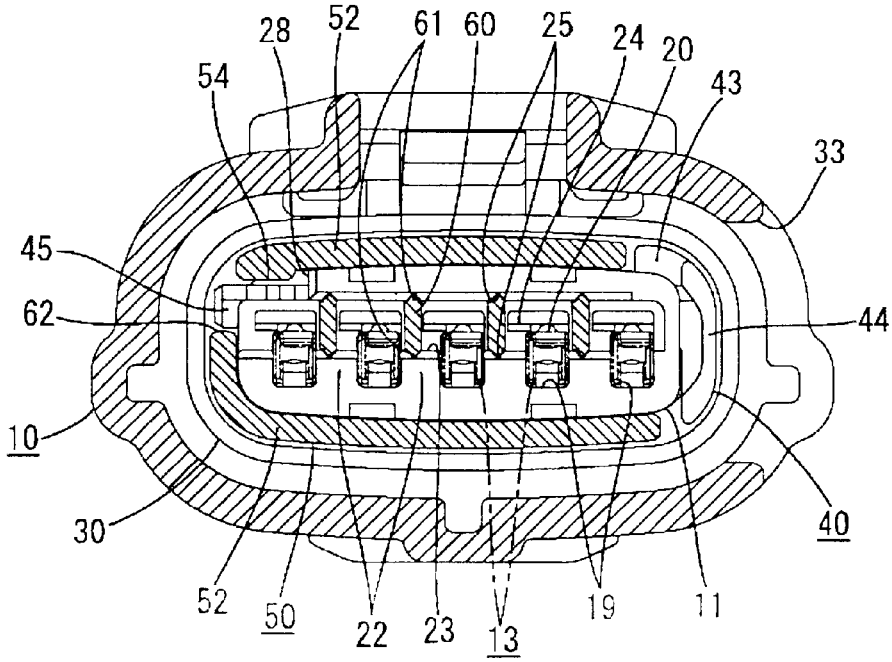
FIG. 16 is a section along 16—16 of FIG. 15.

The retainer 40 is moved to the full locking position after all the terminal fittings 13 are inserted into the cavities 19. At this time, the mount-maneuvering projection 43 of the retainer 40 is pushed by a jig inserted sideways through the retainer insertion hole 33 to push the retainer 40. Thus, the first holding recesses 46 disengage from the holding projections 27 and the second holding recesses 47 engage the holding projections 27, as shown in FIG. 13. As a result the retainer 40 is held at the full locking position. Then, as shown in FIGS. 14 and 15, the locking projections 42 of the retainer 40 project into the cavities 19 to engage the jaws 18 to doubly locking the terminal fittings 13.

Movement of the retainer 40 from the partial locking position to the full locking position causes the rear end of the retainer 40, excluding the detach-maneuvering piece 44, to be concealed by the holder 50. Hence, the retainer 40 cannot be seen from the front. Further, the detecting portion 45 projects to the side of the terminal accommodating portion 11 opposite the side where the retainer 40 is inserted and can be seen through the opening 62 from the front. Thus, an operator can determine that the retainer 40 has reached the full locking or proper position. In this state, the rear surface of the retainer 40 is substantially flush with the side surface of the holder 50. Here, if the detecting portion 45 cannot be seen through the opening 62 or if the rear end 40R of the retainer 40 projects out from the holder 50, the operator determines that the retainer 40 has not reached the full locking position.

The terminal fittings 13 may have to be removed for maintenance. This is accomplished by first moving the retainer 40 from the full locking position to the partial locking position by manipulating the detach-maneuvering piece 44 of the retainer 40 with a jig inserted through the jig insertion recess 56 of the holder 50. The lock 20 then is deformed and disengaged from the engaging portion 17 of the terminal fitting 13 by inserting a jig into the jig insertion hole 59 of the holder 50 from the front and pushing the unlocking piece 24 of the lock 20. The terminal fitting 13 then is pulled out of the cavity 19.

As described above, the detecting portion 45 projects into the opening 62 when the retainer 40 reaches the proper position and can be seen from outside through the opening 62. Thus, the mounted position of the retainer 40 can be detected precisely by checking if the detecting portion 45 can be seen.

When the retainer 40 is at the partial locking position, the detecting portion 45 is retracted from the opening 62, and the rear end of the retainer 40 projects out from the holder 50. When the retainer 40 reaches the full locking position, the detecting portion 45 faces the opening 62, and the rear end 40R of the retainer 40 is inside the holder 50. Thus, the position of the retainer 40 can be detected more precisely by looking at both the detecting portion 45 and the rear end 40R of the retainer 40.

Contrast between the detecting portion 45 and the edge of the opening 62 can be made clearer by coloring the retainer 40 differently from the rubber ring 30 and/or the holding member 50. Thus, visual confirmation of the detecting portion 45 is easier, and position detection of the retainer 40 is more precise. Automatic detection also is possible, e.g. by a color detecting sensor.

The invention is not limited to the above described and illustrated embodiment. For example, following embodiments are also embraced by the technical scope of the present invention as defined by the claims. Beside the following embodiments, various changes can be made without departing from the scope and spirit of the present invention as defined by the claims.

A holder is assembled with the terminal accommodating portion in the foregoing embodiment. However, the invention also is applicable to connectors in which the holder is molded unitarily with the housing main body.

The entire retainer is colored differently from the rubber ring and the holding member in the foregoing embodiment. However, the retainer and the holder may be colored the same, and only the detecting portion may be colored differently from the retainer, the rubber ring and the holder.

A female connector with a receptacle is described above. However, the invention also is applicable to female connectors with no receptacle.

Although the female connector is shown in the foregoing embodiment, the present invention is also applicable to male connectors.

The detecting portion 45 has been described as being visible or detectable via the opening 62. However, the detecting portion 45 may be visible or detectable from additional openings e.g. opposite to the opening 62 (or flush therewith) or from a direction intersecting the direction PID.

What is claimed is:

1. A connector, comprising:

a housing into which at least one terminal fitting is insertable along an inserting direction, the housing having a main body and a holder mountable on the main body, the holder having a stop wall for supporting the terminal fitting inserted into the main body, and a retainer mountable to the housing in a direction at an angle to the inserting direction of the terminal fitting and engageable with the terminal fitting to lock the terminal fitting upon reaching a proper position, wherein the holder has an opening, and the retainer comprises a detecting portion which faces the opening so that the detecting portion can be seen from outside first when the retainer reaches the proper position.

2. The connector of claim 1, wherein the housing comprises a terminal accommodating portion which is adapted to accommodate the terminal fitting and into which the retainer is mountable, wherein a rear end of the retainer with respect to an inserting direction thereof projects out from the terminal accommodating portion before the retainer reaches the proper position with respect to the terminal accommodating portion, whereas the rear end of the retainer is substantially accommodated in the terminal accommodating portion and the detecting portion faces the opening when the retainer reaches the proper position.

3. The connector of claim 2, wherein a receptacle substantially surrounds the terminal accommodating portion.

4. The connector of claim 1, wherein the detecting portion is colored differently from an edge of the opening in the housing.

5. The connector of claim 1, wherein the retainer comprises first holding means and second holding means cooperable with mating holding means on the housing for holding the retainer in a preliminary position where the retainer does not lock the terminal fitting, and in the proper position where the retainer locks the terminal fitting.

6. The connector of claim 1, wherein the retainer comprises at least one locking projection for engaging the respective terminal fitting in the proper position so as to lock the terminal fitting in the housing.

7. The connector of claim 1, wherein a sealing ring is provided on the housing for providing a sealing function when the connector is mated with a mating connector.

8. The connector of claim 7, wherein the holder has a sealing ring holder for locking the sealing ring.

9. The connector of claim 1, wherein the holder is mountable on the main body along a mounting direction substantially opposed to the inserting direction of the terminal fitting.

10. The connector of claim 1, wherein the main body has opposite front and rear ends and the terminal fitting being inserted from the rear end to the front end of the mean body, the holder being mountable on the front end of the main body, such that the detecting portion can be see from the front end of the main body when the retainer reaches the proper position.

11. The connector of claim 1, wherein the holder has at least one insertion hole aligned with the terminal fitting, the opening being offset from the insertion hole.

12. A connector, comprising:

a housing into which at least one terminal fitting is insertable along an inserting direction; and a retainer mountable to the housing in a direction at an angle to the inserting direction of the terminal fitting and engageable with the terminal fitting to lock the terminal fitting upon reaching a proper position, wherein the housing has an opening, and the retainer comprises a detecting portion which faces the opening so that the detecting portion can be seen from outside first when the retainer reaches the proper position, the detecting portion being a color different from a color of an edge of the opening in the housing.

13. A connector, comprising:

a housing having opposite front and rear ends and at least one cavity extending between the ends, the cavity being configured for receiving a terminal fitting insertable along an inserting direction from the rear end toward the front end of the housing;

a retainer mountable to the housing in a retainer inserting direction at an angle to the inserting direction of the terminal fitting and engageable with the terminal fitting to lock the terminal fitting upon reaching a proper position, and wherein the front end of the housing has an opening, and the retainer comprises a detecting portion which is offset from the opening and not visible from the front end of the housing before the retainer reaches the proper position, the detecting portion facing the opening so that the detection portion can be seen from the front end when the retainer reaches the proper position, the opening being offset along the retainer insertion direction from the cavity.

* * * * *